US007797875B1

(12) United States Patent
Carrier et al.

(10) Patent No.: US 7,797,875 B1
(45) Date of Patent: Sep. 21, 2010

(54) PICATINNY RAIL ATTACHMENT

(75) Inventors: Donald J. Carrier, FPO (AP); Bruce B. Leaman, Fredericksburg, VA (US); Nathan D. Joswiak, Fredericksburg, VA (US); Scott I. Jack, College Park, MD (US); Craig A. Keicher, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 343 days.

(21) Appl. No.: 12/152,121

(22) Filed: Apr. 29, 2008

(51) Int. Cl.
*F41G 1/38* (2006.01)

(52) U.S. Cl. ..... 42/124; 42/128; 42/138; 211/85.7

(58) Field of Classification Search ..... 42/12–128, 42/138; 211/85.7
See application file for complete search history.

(56) References Cited

U.S. PATENT DOCUMENTS

| | | | | |
|---|---|---|---|---|
| 4,208,821 | A * | 6/1980 | Power | 42/138 |
| 4,742,636 | A * | 5/1988 | Swan | 42/126 |
| 5,941,489 | A | 8/1999 | Fanelli et al. | 248/298.1 |
| 6,144,308 | A | 11/2000 | Dunne | 340/689 |
| 6,591,538 | B2 * | 7/2003 | Holler | 42/125 |
| 6,594,937 | B2 * | 7/2003 | Weichert et al. | 42/105 |
| 6,629,381 | B1 | 10/2003 | Keng | 42/124 |
| 7,222,451 | B2 | 5/2007 | Keng et al. | 42/94 |
| 7,621,065 | B2 * | 11/2009 | Gablowski | 42/135 |
| 7,647,720 | B1 * | 1/2010 | Vendetti | 42/126 |
| 7,661,221 | B2 * | 2/2010 | Holmberg | 42/106 |
| 7,685,758 | B2 * | 3/2010 | Romer | 42/124 |
| 7,694,450 | B2 * | 4/2010 | Keng | 42/124 |
| 2005/0111097 | A1 * | 5/2005 | Iannarelli et al. | 359/409 |

OTHER PUBLICATIONS

MIL-STD-1913(AR),Dimenmsioning of Accessory Mounting Rail for Small Arms Weapons, Feb. 3, 1995.

* cited by examiner

*Primary Examiner*—Troy Chambers
*Assistant Examiner*—Samir Abdosh
(74) *Attorney, Agent, or Firm*—Gerhard W. Thielman Esq.

(57) ABSTRACT

An interface device is provided for securing a range finder to a Picatinny rail. The device has a longitudinal direction with first and second mounts, which are pivotably connected to open and closed configurations. The mounts are in substantially parallel and coaxial mutual positions along the longitudinal direction while in the closed configuration, and instead rotated along a first axis substantially perpendicular to the longitudinal direction in the open configuration. The device further includes a stock onto which the Picatinny rail attaches along the longitudinal direction, the stock being pivotably connecting to the first mount along a second axis substantially parallel to the first axis to one of a lock configuration to be substantially parallel to the first mount and a release configuration to pitch said stock relative to the first mount.

5 Claims, 5 Drawing Sheets

PICATINNY RAIL ATTACHMENT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to clamping attachments in conjunction with Picatinny rails. In particular, the clamping attachment provides an alignment interface between a range finder and a Picatinny rail-mounted gunsight.

The United States Marine Corps (USMC) employs the Common Laser Range Finder (CLRF) for targeting objects to engage (not untypically with hostile fire). The CLRF provides image intensification and thermal weapon sights for use with infantry weapons, particularly for low-light applications.

SUMMARY

Conventional attachments for weapons yield disadvantages addressed by various exemplary embodiments of the present invention. In particular, deficiencies in stability, alignment and assembly have plagued previous designs. Various exemplary embodiments provide an interface device securing a range finder to a Picatinny rail, the device having a longitudinal direction. The device includes first and second mounts, which are pivotably connected to open and closed configurations. The mounts are in substantially parallel and coaxial mutual positions along the longitudinal direction while in the closed configuration, and instead rotated along a first axis substantially perpendicular to the longitudinal direction in the open configuration. The device further includes a stock onto which the Picatinny rail attaches along the longitudinal direction, the stock being pivotably connecting to the first mount along a second axis substantially parallel to the first axis to one of a lock configuration to be substantially parallel to the first mount and a release configuration to pitch said stock relative to the first mount.

In these embodiments, the stock in the lock configuration applies tension to the first mount to maintain the mounts in said closed configuration, and the stock in the release configuration relaxes the first mount to enable the mounts to rotate into the open configuration. The device further includes first and second members to engage the range finder. The first member is rigidly disposed on the first mount. The second member is rigidly disposed on said second mount. The first and second members mechanically engage the range finder therebetween by disposing the first member against one end of the range finder while the mounts are in the open configuration, rotating the second mount to conform to the closed configuration, thereby disposing the second member against opposite end of the range finder.

Various exemplary embodiments also provide a slide connector that translates in the longitudinal direction along the first mount with a pivot pin that rotates within the slide connector along a third axis substantially perpendicular to the longitudinal direction and the first axis, along with a cross-beam connected to the first mount by the pivot pin, wherein the cross-beam is disposed substantially parallel to the longitudinal direction in a stowage configuration and disposed substantially perpendicular to the longitudinal direction in a deployed configuration to engage the range finder. Alternate embodiments provide a hinge link having a mount pin that pivotably connects the first and second mounts and a stock pin that pivotably connects the first mount to the stock.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
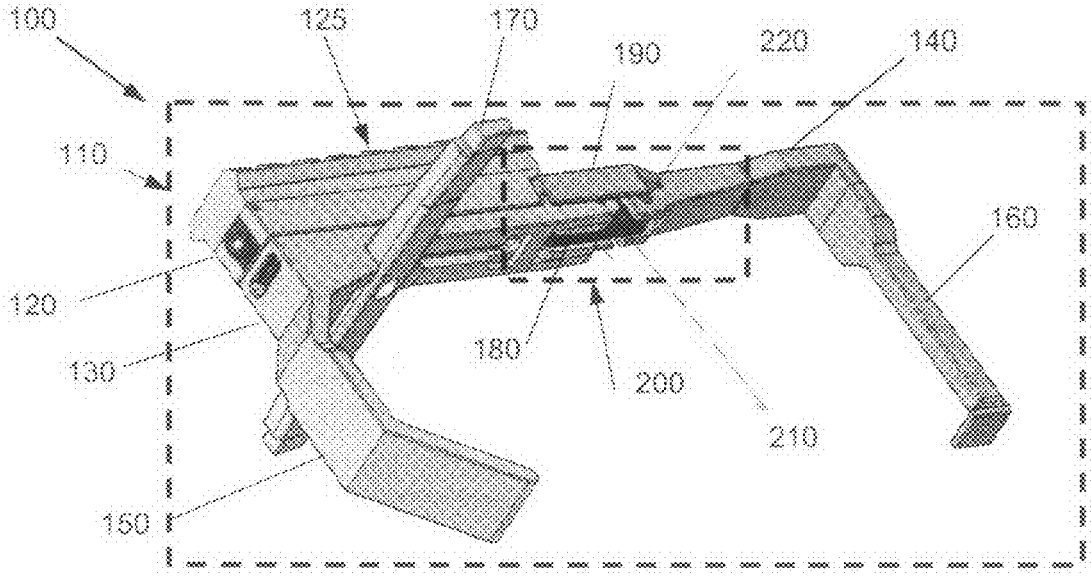
FIG. 1 is a first perspective view of a vector rail attachment.

FIG. 1 shows a first perspective view 100 of a vector rail attachment 110 (within an encompassing dash rectangle). The mechanism as shown includes a pivotable stock (or block) 120 on which a Picatinny rail 125 is disposed on the distal side. Along the attachment's longitudinal axis are disposed forward and aft mounts 130, 140 being coaxial to each other. The stock 120 can pitch relative to the forward mount 130. A forward hook 150 extends from the forward mount 130, and an aft hook 160 extends from the aft mount 140. A cross-beam (or stabilizer bar) 170 pivotably connects to the forward mount 130 below the proximal side of the stock 120.

Figure 2:
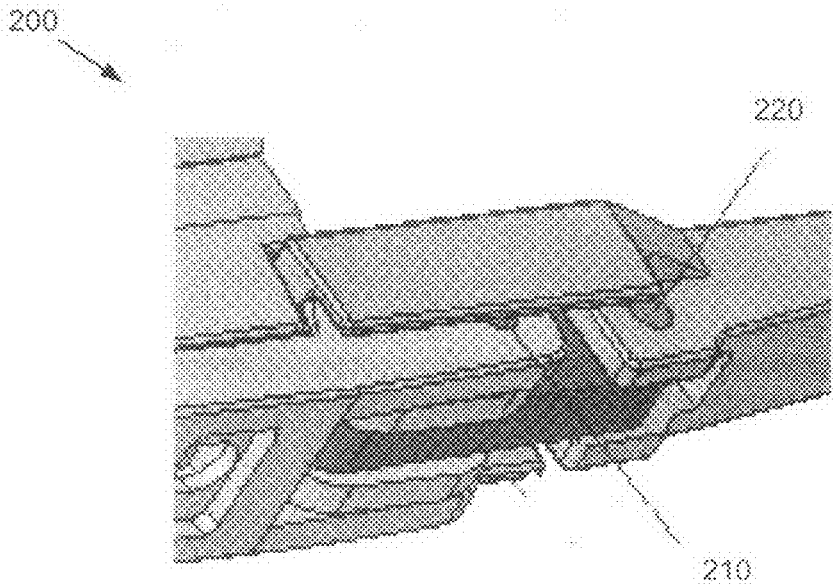
FIG. 2 is a detail of the rail attachment from the first perspective.

A hinge link 180 is disposed between the forward and aft mounts 130, 140, shown within a dash rectangular region that denotes boundaries for FIG. 2 in detail 200. The link 180 engages with forward and aft pins 210, 220. The forward pin 210 pivotably connects the stock 120 to the forward mount 130 forward pin 210. The aft pin 220 pivotably connects the aft mount 140 to enable rotational movement between the forward and aft mounts 130, 140. The pins 210, 220 are substantially parallel to each other and substantially perpendicular to the longitudinal axis. The stock 120 locked parallel to the forward mount 130 provides tension to the link 180 to maintain the mounts 130, 140 in mutually parallel and coaxial positions, labeled the closed position. A pair of flanges 190 extends forward from the aft mount 140, and flanking the pins 210, 220.

Figure 3:
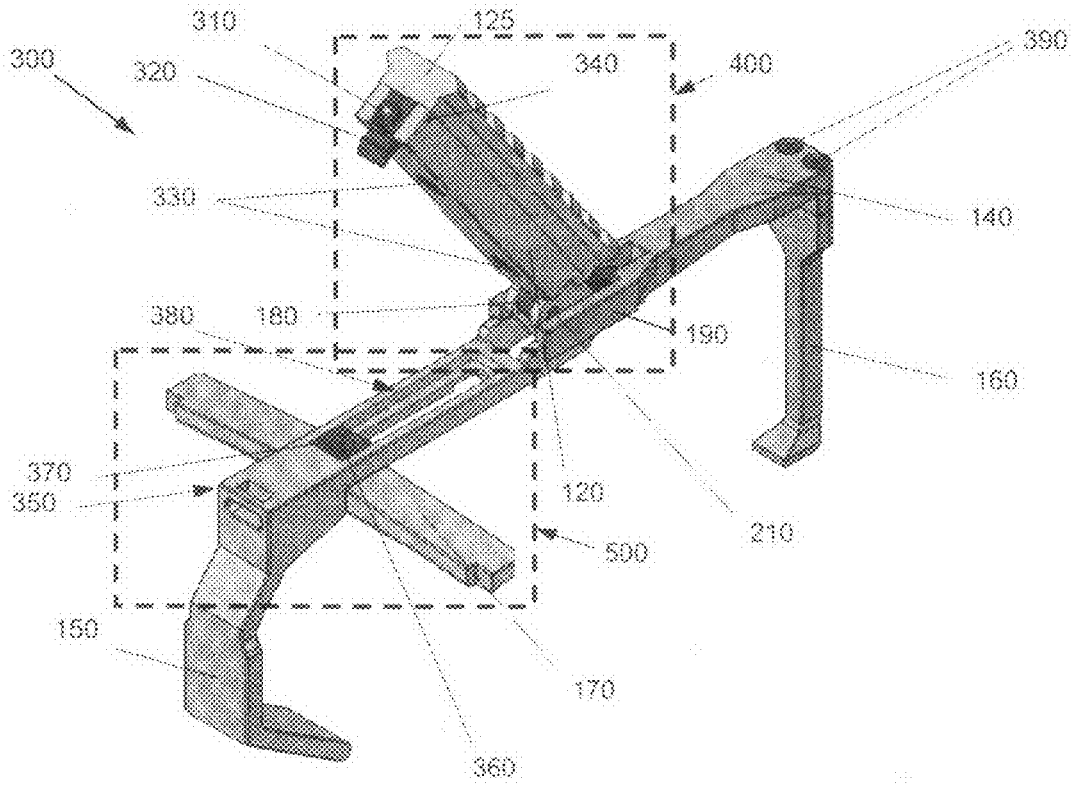
FIG. 3 is a second perspective view of the rail attachment.

FIG. 3 shows a second perspective view 300 of the vector rail attachment 110 with the stock 120 pitched out from the forward mount 130. A release button 310 and a latch 320 are disposed at the block's forward end. Rail screws 330 are disposed along the proximal side of the stock 120. A release pin 340 disengages a lock for the button 310 to enable the latch 320 to release from latch slots 350 within the forward mount 130. An operator can press the button 310 to release the latch 320, thereby relaxing the tension applied by the stock 120 against the forward mount 130 that maintains the link 180 and the aft mount 140 into the open configuration.

As can be observed, the Picatinny rail 125 and stock 125 in FIG. 1 are shown in the lock configuration, being substantially parallel to the forward mount 130, thereby maintaining the mounts 130, 140 tight in the closed configuration. By contrast, the Picatinny rail 125 and stock 125 in FIG. 3 are shown in the release configuration (after pressing the button 310), hinged to pitch relative to the forward mount 130 at forward pin 210. By releasing the latch 320, the mounts 130, 140 can be swung into the open configuration. The relative positions between the components in the closed configuration for the mounts 130, 140 and the lock configuration for the stock 120 and the forward mount 130 are substantially parallel to each other and the longitudinal axis, with their respective mutual pins 220, 210 being substantially perpendicular to that axis.

Figure 4:
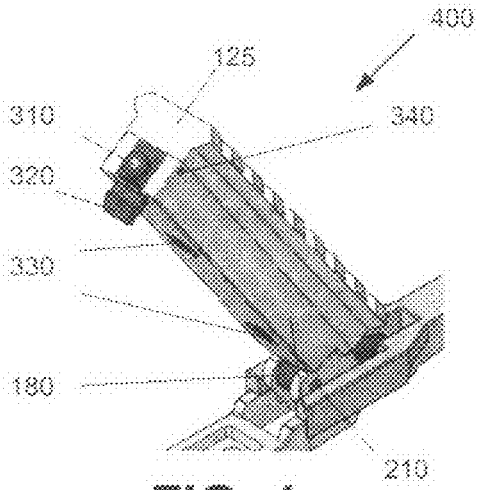
FIGS. 4 and 5 are details of the rail attachment from the second perspective.
Figure 5:
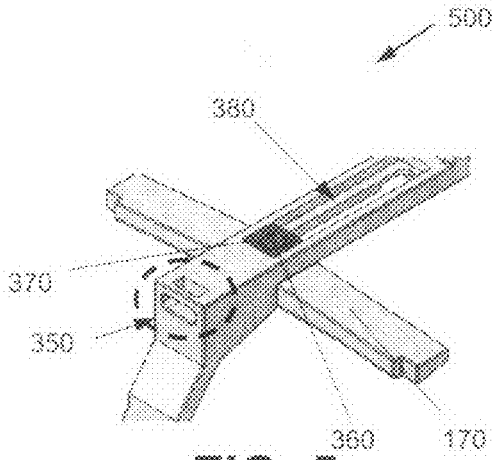

The cross-beam 170 rotates on a slide screw 360 mounted within a slide 370, which translates along a travel slot 380 that extends longitudinally along the forward mount 130. Hinge extension screws 390 provide attachment between the aft mount 140 and the aft hook 160. In order to provide greater design versatility, the aft mount 140 and the aft hook 160 can be produced as separate components, or alternatively combined as an integral unit. FIG. 4 shows the stock 120 in detail 400. FIG. 5 shows the forward mount 130 and cross-beam 170 in detail 500, with a dash oval identifying the latch slots 350.

Figure 6:
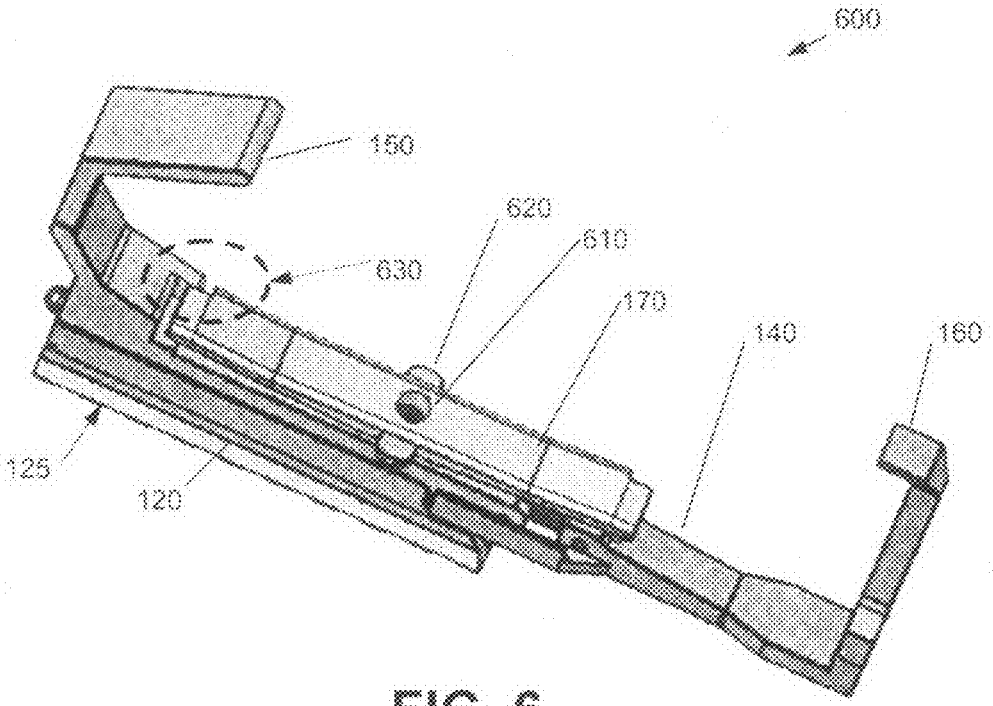
FIGS. 6, 7 and 8 are third perspective views of the rail attachment showing deployment of the cross-beam.
Figure 7:
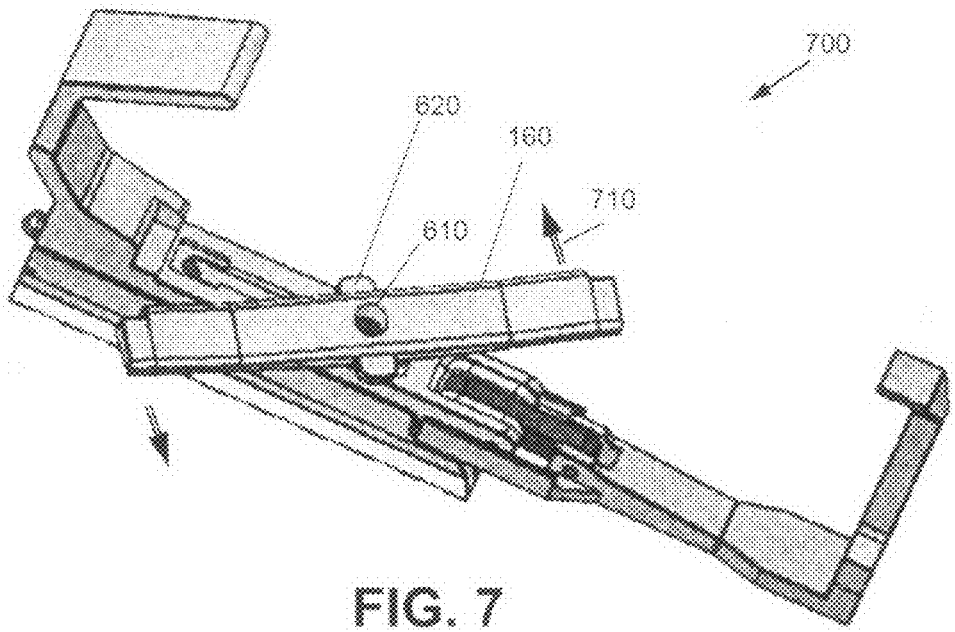
Figure 8:
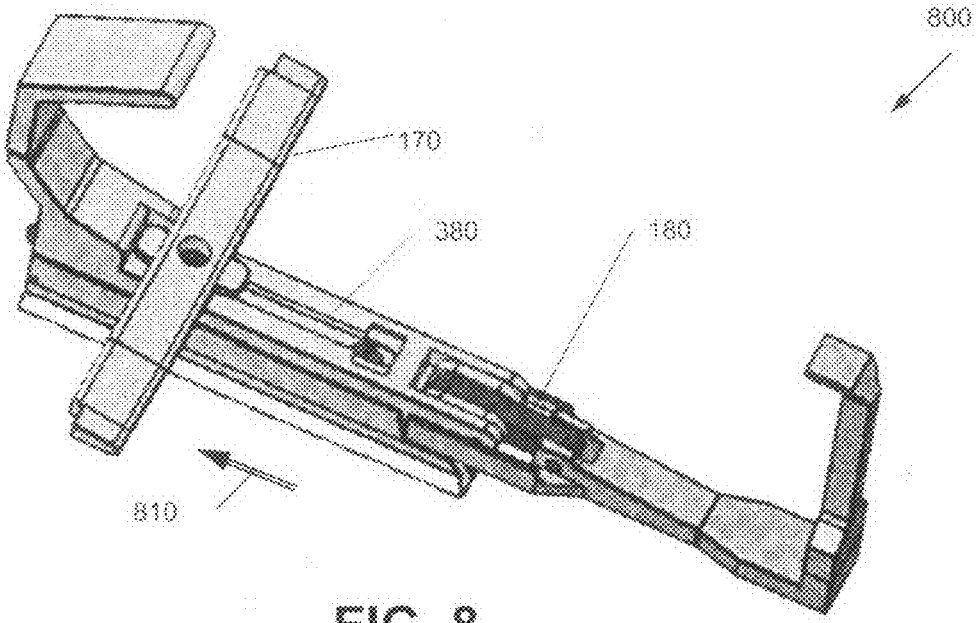

FIGS. 6-8 show third perspective exploded views of the rail attachment 110 with the cross-beam 170 in alternate positions. The stowed view 600 in FIG. 6 shows a pivot pin 610 corresponding to the slide screw 360, and a pair of flanges 620 that extend substantially perpendicular from the cross-beam 170. (The pivot pin 610 may optionally be integral or connected to the slide screw 360.) A dash oval 630 shows an interface region between a flange protrusion on the forward mount 130 and the forward outer ends of the cross-beam 170. In the stowed configuration, the cross-beam 170 remains substantially parallel to the forward mount 130.

The deploying view 700 in FIG. 7 shows the cross-beam 170 rotating counter-clockwise from the inverted perspective shown, as indicated by arrows 710. Upon completion of a right angle (i.e., 90° or $\pi/4$ radian) rotation, the cross-beam 170 extends outward from the attachment's longitudinal axis to be substantially perpendicular thereto. The deployed view 800 in FIG. 8 shows the cross-beam 170 after translating forward, as indicated by arrow 810, until one of the flanges 620 abuts the forward mount 130. In the deployed configuration, the cross-beam 170 is disposed substantially perpendicular to the longitudinal axis and correspondingly the forward mount 130.

Figure 9:
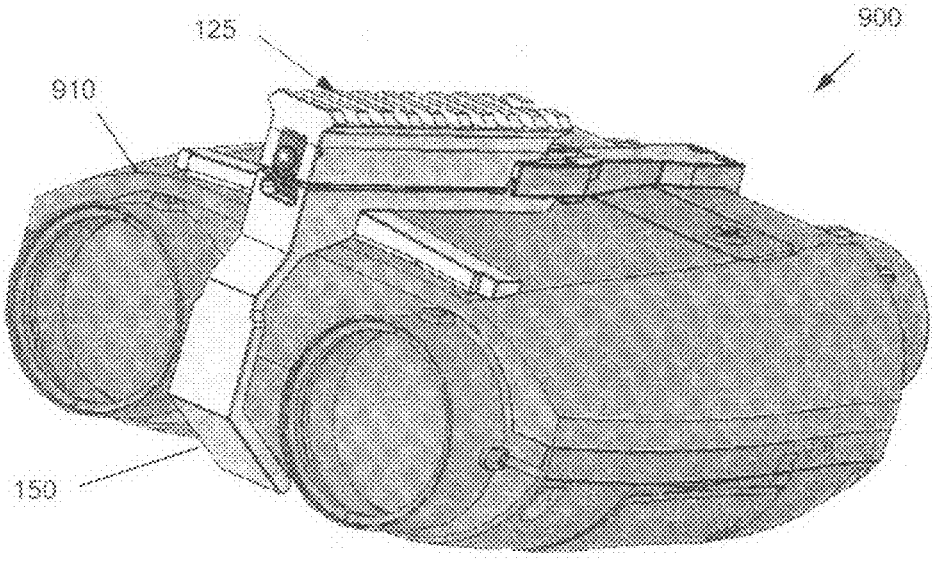
FIG. 9 is a fourth perspective view of the rail attachment with a range finder attached thereto.
Figure 10:
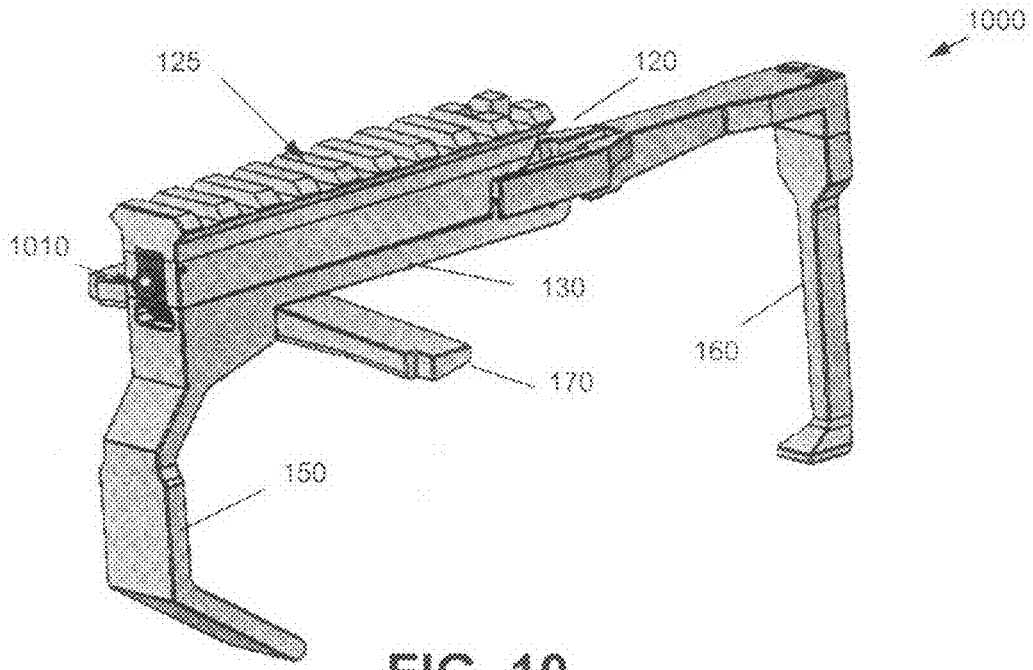
FIGS. 10 and 11 are fifth perspective views of the rail attachment showing tilt adjustment of the rail block.
Figure 11:
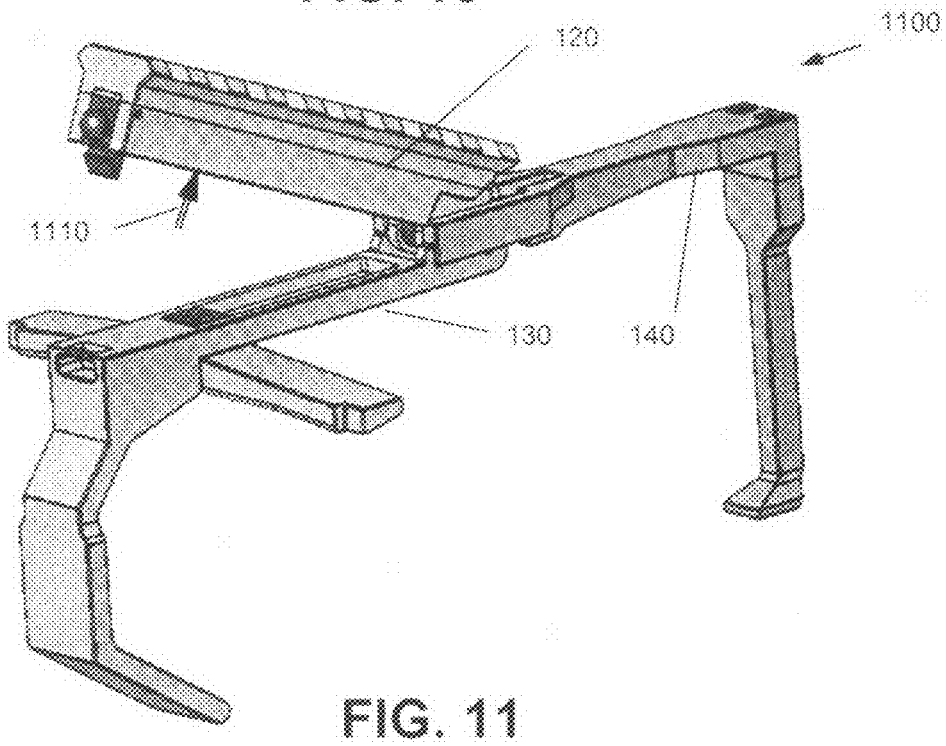

FIG. 9 shows a fourth perspective view 900 of the rail attachment 110. A range finder 910, such as the Common Laser Range Finder (CLRF) (resembling binoculars) is clamped secure to the rail attachment 110 between the hooks 150, 160, with the Picatinny rail 125 above. FIGS. 10 and 11 show a fifth perspective of the rail attachment 110. FIG. 10 shows a latch position 1000 with the stock 120 parallel to the forward mount 130, and the latching mechanisms 1010 (as exemplified by the latch 320 engaging with the slots 350) being engaged. FIG. 11 shows an unlatch position 1100 with the stock 120 pitching upward from the forward mount 130 along angular direction arrow 1110.

The vector rail attachment 110 has a cross-beam 170 that performs as a stabilizer bar for the range finder 910. The cross-beam 170 can be keyed for one-way rotation to ensure proper opening and closing procedures of attachment. To secure the rail attachment 110 to the range finder 910, an operator first rotates and slides the cross-beam 170, as shown in FIGS. 6-8 from stowage to deployment into its open locking position. Second, the operator applies pressure to the release button 310 and pitches open the stock 120, as shown in FIGS. 10-11 to release the attachment's tension, thereby enabling relative rotation between the mounts 130, 140 into the open configuration.

Third, the operator positions the rail attachment 110 over the range finder 910 shown in FIG. 9. The operator rotates the aft mount 140 and aft hook 160 closed, thereby applying pressure and fixating the rail attachment 110 to the mounts 130, 140 being parallel in the closed configuration. The rail attachment 110 is now stable and secure on the range finder 910, readying the assembly for any variety of Image Intensifiers and Thermal Imagers that mate with the Picatinny rail 125. The operator reverses the operation steps for proper removal procedures of the rail attachment 110 from the range finder 910.

Using the above-described rail attachment 110, a Marine operator can universally and conveniently attach present and future technology add-on attributes onto the range finder 910. The vector rail attachment 110 can be produced from a variety of lightweight materials having satisfactory nonmagnetic and durability characteristics.

The vector rail attachment 110 represents an interface device onto the range finder (e.g., USMC CLRF) to provide an optically aligned Picatinny rail for securing military Image Intensifiers and Thermal Weapon Sights with standard Picatinny Rail Interfaces.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An interface device for securing a range finder to a Picatinny rail, said device having a longitudinal direction and comprising:

first and second mounts being pivotably connected to a closed configuration with substantially parallel and coaxial mutual positions along the longitudinal direction and an open configuration with said mounts being rotated along a first axis substantially perpendicular to the longitudinal direction;

a stock onto which the Picatinny rail attaches along the longitudinal direction, said stock pivotably connecting to said first mount along a second axis substantially parallel to said first axis to one of a lock configuration to be substantially parallel to said first mount and a release configuration to pitch said stock relative to said first mount, whereas said stock in said lock configuration applies tension to said first mount to maintain said mounts in said closed configuration, and said stock in said release configuration relaxes said first mount to enable said mounts to rotate into said open configuration;

a first member rigidly disposed on said first mount; and a second member rigidly disposed on said second mount, wherein said first and second members mechanically engage the range finder therebetween by disposing said first member against one end of the range finder while said mounts are in said open configuration, rotating said second mount to conform to said closed configuration, thereby disposing said second member against opposite end of the range finder.

2. The device according to claim 1, further comprising:

a slide connector that translates in the longitudinal direction along said first mount;

a pivot pin that rotates within said slide connector along a third axis substantially perpendicular to the longitudinal direction and said first axis; and a cross-beam connected to said first mount by said pivot pin, wherein said cross-beam is disposed substantially parallel to the longitudinal direction in a stowage configuration and disposed substantially perpendicular to the longitudinal direction in a deployed configuration to engage the range finder.

3. The device according to claim 1, further comprising:

a hinge link having a mount pin that pivotably connects said first and second mounts and a stock pin that pivotably connects said first mount to said stock.

4. The device according to claim 1, wherein said stock further includes a latch that engages said first mount in said lock configuration, the latch being releasable to said release configuration in response to force applied to a button disposed on the stock.

5. The device according to claim 1, wherein said second mount and said second member are rigidly connected by at least one screw.

* * * * *